US010366670B2

(12) United States Patent
Zhang

(10) Patent No.: US 10,366,670 B2
(45) Date of Patent: Jul. 30, 2019

(54) COMPENSATION CIRCUIT FOR COMMON ELECTRODE VOLTAGE AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventor: Jian Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 312 days.

(21) Appl. No.: 15/255,401

(22) Filed: Sep. 2, 2016

(65) Prior Publication Data

US 2017/0229090 A1 Aug. 10, 2017

(30) Foreign Application Priority Data

Feb. 4, 2016 (CN) ..... 2016 1 0080841

(51) Int. Cl.
*G09G 5/00* (2006.01)
*G09G 3/36* (2006.01)

(52) U.S. Cl.
CPC ..... *G09G 5/003* (2013.01); *G09G 3/3655* (2013.01); *G09G 2300/0814* (2013.01); *G09G 2300/0823* (2013.01); *G09G 2300/0833* (2013.01); *G09G 2320/0209* (2013.01); *G09G 2320/0219* (2013.01); *G09G 2330/021* (2013.01); *G09G 2330/028* (2013.01)

(58) Field of Classification Search
None
See application file for complete search history.

(56) References Cited

U.S. PATENT DOCUMENTS

2007/0024565 A1* 2/2007 Choi ..... G09G 3/3655 345/98
2009/0002303 A1* 1/2009 Huang ..... G09G 3/3655 345/89

(Continued)

FOREIGN PATENT DOCUMENTS

CN 104217680 A * 12/2014 ..... G09G 3/3614

*Primary Examiner* — Lunyi Yao
*Assistant Examiner* — Benjamin X Casarez
(74) *Attorney, Agent, or Firm* — Collard & Roe, P.C.

(57) ABSTRACT

A compensation circuit for a common electrode voltage and a display device. The compensation circuit includes a control module, a selection module, a transmission module and an output module. The control module generates a control signal and transmits the control signal to the selection module. The selection module selects one of a signal from a first common electrode voltage terminal, a signal from a second common electrode voltage terminal, a signal from a third common electrode voltage terminal and a signal from a fourth common electrode voltage terminal as an input signal based on the control signal and a signal from a turn-on voltage terminal, and transmits the input signal to the output module. The transmission module transmits the feedback signal received from the control module to the output module. The output module generates a compensation signal based on the feedback signal and the input signal.

12 Claims, 3 Drawing Sheets

(56) References Cited

U.S. PATENT DOCUMENTS

| | | | | |
|---|---|---|---|---|
| 2012/0218250 | A1* | 8/2012 | Pei | G09G 3/3655 345/212 |
| 2014/0062990 | A1* | 3/2014 | Zhang | G09G 3/3696 345/212 |
| 2015/0062471 | A1* | 3/2015 | Sung | G09G 3/3655 349/33 |
| 2016/0063941 | A1* | 3/2016 | Xu | G09G 3/3614 345/212 |
| 2016/0149574 | A1* | 5/2016 | Cui | H03K 19/00369 327/513 |
| 2016/0171943 | A1* | 6/2016 | Baek | G09G 3/3614 345/209 |
| 2016/0334658 | A1* | 11/2016 | Jo | G09G 3/3655 |

* cited by examiner

COMPENSATION CIRCUIT FOR COMMON ELECTRODE VOLTAGE AND DISPLAY DEVICE

CROSS REFERENCE TO RELATED APPLICATIONS

Applicant claims priority under 35 U.S.C. § 119 of Chinese Application No. 201610080841.7 filed on Feb. 4, 2016, the disclosure of which is incorporated by reference.

TECHNICAL FIELD

Embodiments of the disclosure relate to a compensation circuit for a common electrode voltage and a display device.

BACKGROUND

Currently, with the development of display technologies, sizes of display devices are needed to be ever large and resolutions of display devices are needed to be ever high. As a result, loads of display devices become larger and larger, which may cause coupling capacitances between data lines and common electrodes to be higher as well. As data signals on data lines switch between a low level signal and a high level signal, coupling effect occurs on common electrodes and a degree of coupling on the common electrodes may also change. When the degree of coupling on common electrodes is severe or transits from slight to severe, problems such as crosstalk or greenish display may occur on the display device, thereby compromising display effect of the display device.

SUMMARY

In one aspect, embodiments of the disclosure provide a compensation circuit for a common electrode voltage, including a control module, a selection module, a transmission module and an output module.

The control module is connected to a feedback signal terminal, a first reference voltage terminal, a second reference voltage terminal, the selection module and the transmission module respectively, and is configured to: generate a control signal based on a feedback signal from the feedback signal terminal, a signal from the first reference voltage terminal and a signal from the second reference voltage terminal; and transmit the control signal to the selection module.

The selection module is connected to a first common electrode voltage terminal, a second common electrode voltage terminal, a third common electrode voltage terminal, a fourth common electrode voltage terminal, a turn-on voltage terminal and the output module respectively, and is configured to: select one of a signal from the first common electrode voltage terminal, a signal from the second common electrode voltage terminal, a signal from the third common electrode voltage terminal and a signal from the fourth common electrode voltage terminal as an input signal based on the control signal and a signal from the turn-on voltage terminal; and transmit the input signal to the output module.

The transmission module is connected to the output module and is configured to transmit the feedback signal received from the control module to the output module.

The output module is configured to generate a compensation signal based on the feedback signal and the input signal.

In another aspect, embodiments of the disclosure provide a display device including the above compensation circuit for the common electrode voltage.

BRIEF DESCRIPTION OF THE DRAWINGS

In order to illustrate the technical solutions in the embodiments of the present disclosure or the existing arts more clearly, the drawings need to be used in the description of the embodiments or the existing arts will be briefly described in the following; it is obvious that the drawings described below are only related to some embodiments of the present disclosure, for one ordinary skilled person in the art, other drawings can be obtained according to these drawings without making other inventive work.

DETAILED DESCRIPTION

Hereafter, the technical solutions of the embodiments of the present disclosure will be described in a clearly and fully understandable way in connection with the drawings related to the embodiments of the disclosure. It is obvious that the described embodiments are just a part but not all of the embodiments of the present disclosure. Based on embodiments of the present disclosure, all other embodiments obtained by those skilled in the art without making other inventive work should be within the scope of the present disclosure.

Figure 1:
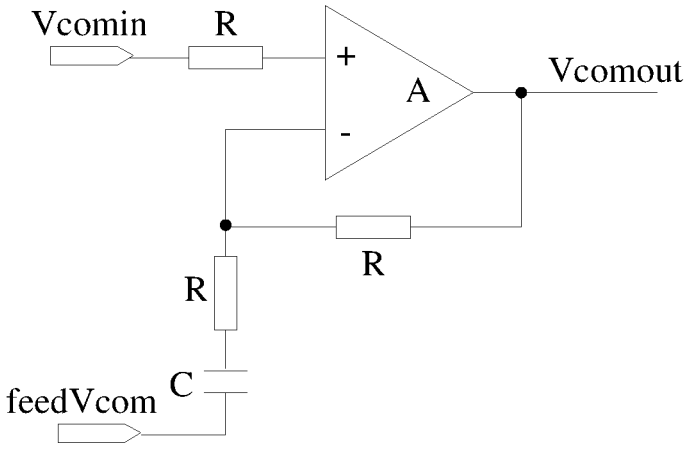
FIG. 1 schematically illustrates a compensation circuit for a common electrode voltage in conventional technologies.

Conventional technologies generally use feedback voltages of the common electrodes to compensate the common electrode voltages. FIG. 1 schematically illustrates a compensation circuit for a common electrode voltage in the conventional technologies. As illustrated in FIG. 1, a non-inverting input terminal "+" of an amplifier A is connected to a signal terminal Vcomin, an inverting input terminal "−" of the amplifier A is connected to a feedback signal terminal feedVcom, the feedback signal terminal feedVcom is connected to a common electrode to be compensated, and an output terminal Vcomout of the amplifier A introduces an outputted compensation signal into the common electrode to be compensated, thereby compensating the common electrode voltage.

However, as a feedback signal of the feedback terminal feedVcom is only fed back to the inverting input terminal "−" of the amplifier A, and a fixed input signal of the input signal terminal Vcomin is inputted into the non-inverting input terminal "+" of the amplifier A, it may take some time to adjust the compensation signal outputted by the amplifier A into a signal suitable for compensating the common electrode voltage. Thus, when it needs to compensate the common electrode voltage due to a severe degree of coupling on common electrodes or transition from a slight degree of coupling to a severe degree of coupling, the compensation circuit for the common electrode voltage in the conventional technologies cannot appropriately compensate the common electrode voltage in time, thereby compromising the display effect of the display device.

Embodiments of the disclosure provide a compensation circuit for a common electrode voltage and a display device. The compensation circuit for the common electrode voltage is configured for outputting an appropriate compensation signal in time when coupling effect occurs on common electrodes, thereby guaranteeing display effect of the display device.

In order to further illustrate the compensation circuit for the common electrode voltage and the display device provided by the embodiments of the disclosure, detailed description will be given below with reference to the figures.

Embodiment 1

Figure 2:
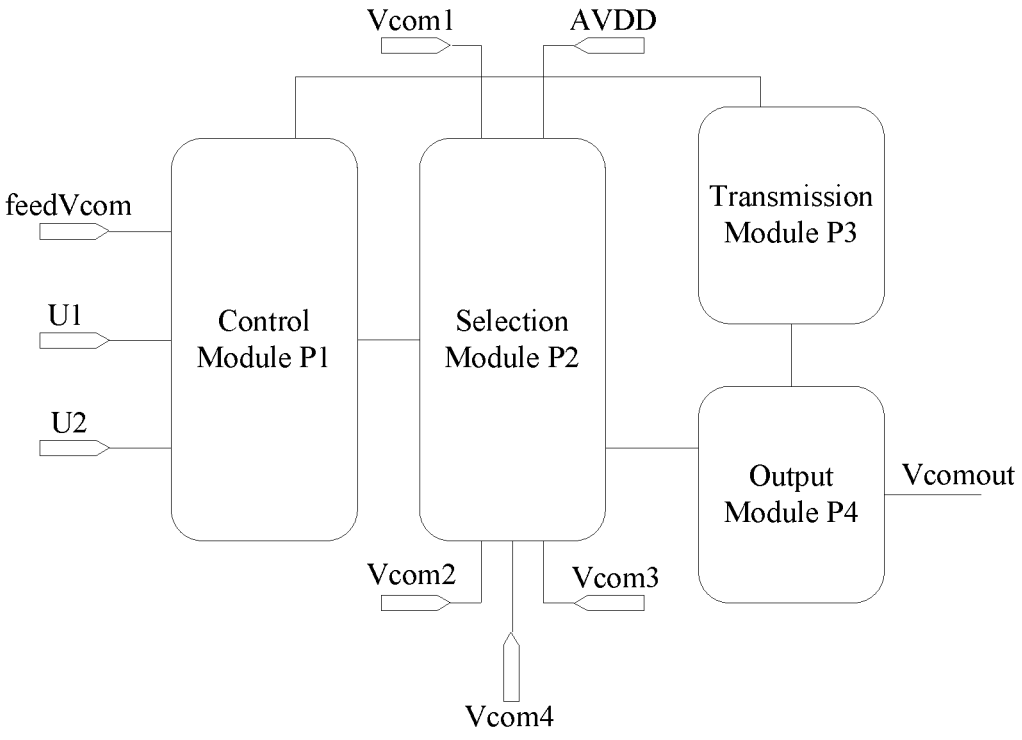
FIG. 2 schematically illustrates a compensation circuit for a common electrode voltage in accordance with an embodiment of the disclosure.

With reference to FIG. 2, a compensation circuit for a common electrode voltage provided by the embodiment of the disclosure comprises a control module P1, a selection module P2, a transmission module P3 and an output module P4. The control module P1 is connected to a feedback signal terminal feedVcom, a first reference voltage terminal U1, a second reference voltage terminal U2, the selection module P2 and the transmission module P3 respectively. The control module P1 is configured to generate a control signal based on a feedback signal from the feedback signal terminal feedVcom, a signal from the first reference voltage terminal U1 and a signal from the second reference voltage terminal U2, and to transmit the control signal to the selection module P2. It is noted that the feedback signal terminal feedVcom is connected to the common electrode to be compensated; that is, the feedback signal of the feedback terminal feedVcom is provided by the common electrode to be compensated. The selection module P2 is connected to a first common electrode voltage terminal Vcom1, a second common electrode voltage terminal Vcom2, a third common electrode voltage terminal Vcom3, a fourth common electrode voltage terminal Vcom4, a turn-on voltage terminal AVDD and the output module P4 respectively. The selection module P2 is configured for selecting one of (1) a signal from the first common electrode voltage terminal Vcom1, (2) a signal from the second common electrode voltage terminal Vcom2, (3) a signal from the third common electrode voltage terminal Vcom3 and (4) a signal from the fourth common electrode voltage terminal Vcom4 as an input signal to transmit to the output module P4 based on the control signal and a signal from the turn-on voltage terminal AVDD. As an example, a voltage of the signal from the first common electrode voltage terminal Vcom1, a voltage of the signal from the second common electrode voltage terminal Vcom2, a voltage of the signal from the third common electrode voltage terminal Vcom3, and a voltage of the signal from the fourth common electrode voltage terminal Vcom4 are all different from each other. The transmission module P3 is connected to the output module P4 and is configured for transmitting the feedback signal received from the control module P1 to the output module P4. The output module P4 is configured for generating a compensation signal based on the feedback signal and the input signal, and outputting the compensation signal through the output terminal Vcomout of the output module P4.

With reference to the structure of the compensation circuit for the common electrode voltage provided by Embodiment 1 of the disclosure, a driving method for the compensation circuit for the common electrode voltage will be described in the following, where the compensation process is divided into the following three stages:

In a first stage, the control module P1 receives the feedback signal from the feedback signal terminal feedVcom, where the feedback signal is provided by the common electrode to be compensated (that is, the feedback signal is from the common electrode to be compensated). The control module P1 generates the control signal based on the feedback signal, the signal from the first reference voltage terminal U1 and the signal from the second reference voltage terminal U2, and transmits the control signal to the selection module P2. As an example, a lower threshold and an upper threshold of the control module P1 can be obtained based on a voltage of the signal of the first reference voltage terminal U1 and a voltage of the signal of the second reference voltage terminal U2. The control module P1 can compare the voltage of the feedback signal with the lower and upper thresholds, and generate the control signal based on a relationship between the voltage of the feedback signal and the lower and upper thresholds. A different relationship between the voltage of the feedback signal and the lower and upper thresholds may lead to generation of a different control signal. The control signal is configured for controlling the selection module P2 to select one of the signal from the first common electrode voltage terminal Vcom1, the signal from the second common electrode voltage terminal Vcom2, the signal from the third common electrode voltage terminal Vcom3 and the signal from the fourth common electrode voltage terminal Vcom4 as an input signal to the output module P4.

In a second stage, the selection module P2 receives the control signal, and selects one of the signal from the first common electrode voltage terminal Vcom1, the signal from the second common electrode voltage terminal Vcom2, the signal from the third common electrode voltage terminal Vcom3 and the signal from the fourth common electrode voltage terminal Vcom4 as the input signal to transmit to the output module P4 based on the control signal and the signal from the turn-on voltage terminal AVDD; that is, the output terminal of the selection module P2 is connected to the input terminal of the output module P4. The voltage of the signal from the first common electrode voltage terminal Vcom1, the voltage of the signal from the second common electrode voltage terminal Vcom2, the voltage of the signal from the third common electrode voltage terminal Vcom3 and the voltage of the signal from the fourth common electrode voltage terminal Vcom4 are all different from each other, and a specific value of each of the voltages may be set according to practical application scenarios of the compensation circuit for the common electrode voltage.

In a third stage, the transmission module P3 transmits the feedback signal from the control module P1 to the output module P4, such that the output module P4 generates the compensation signal based on the feedback signal and the input signal transmitted to the output module P4 in the second stage. The output module P4 transmits the compensation signal to the common electrode to be compensated, thereby compensating the common electrode voltage.

Figure 3:
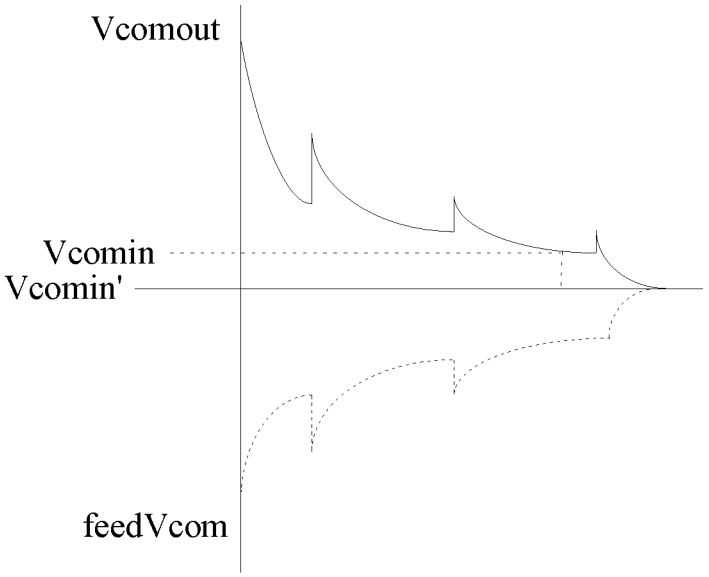
FIG. 3 schematically illustrates compensation effect of a compensation circuit for a common electrode voltage in accordance with an embodiment of the disclosure.
Figure 4:
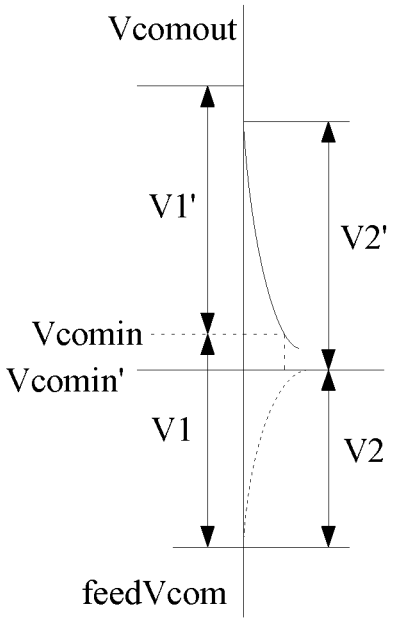
FIG. 4 schematically illustrates part of the compensation effect shown in FIG. 3.

It is noted that, with reference to FIG. 3 and FIG. 4, FIG. 4 is an example diagram of a part of FIG. 3. Vcomout represents a voltage of the compensation signal outputted by the output module P4, feedVcom is a voltage of the feedback signal, Vcomin is a voltage of an input signal of an output module P4 in conventional technologies, Vcomin' is a voltage of the input signal of the output module P4 in the embodiment of the disclosure, and V1, V1', V2, V2' are voltage differences between the voltages of various signals as illustrated in FIG. 3. In conventional technologies, the output module P4 generates the output signal based on the feedback signal and the input signal, and uses the output signal as the compensation signal for the common electrode voltage, where the input signal of the output module P4 in conventional technologies is constant. In this case, a specific form of the output signal of the output module P4 is determined by the feedback signal, and the output signal cannot compensate the common electrode voltage when there is coupling effect on the common electrode. In the embodiment of the disclosure, the input signal of the output module P4 in the compensation circuit for the common electrode voltage is selected by the selection module P2 and transmitted to the output module P4; that is, a specific form of the output signal of the output module P4 is determined by the selectable input signal and the feedback signal together, thereby capable of appropriately compensating the common electrode voltage in time when there is coupling effect on the common electrode. As an example, when there is coupling effect on the common electrode and the voltage of the feedback signal collapses downwards, the voltage of the input signal is uplifted in this period of time, thereby guaranteeing that a compensation signal for compensating the common electrode voltage can be generated in time.

The compensation circuit for the common electrode voltage provided by the embodiment of the disclosure comprises the control module P1, the selection module P2, the transmission module P3 and the output module P4. Compared with a compensation circuit for a common electrode voltage with a configuration of inputting a feedback signal and a constant input signal into the amplifier A1 in existing technologies, in the embodiment of the disclosure the control module P1 of the compensation circuit for the common electrode voltage can generate the control signal based on a feedback signal from the feedback signal terminal feedVcom, a signal from the first reference voltage terminal U1 and a signal from the second reference voltage terminal U2, thereby controlling the selection module P2 to select one of the signal from the first common electrode voltage terminal Vcom1, the signal from the second common electrode voltage terminal Vcom2, the signal from the third common electrode voltage terminal Vcom3 and the signal from the fourth common electrode voltage terminal Vcom4 as an input signal inputted to the output module P4. As the feedback signal can reflect the coupling status of the common electrode, the control module P1 can control the selection module P2 to select an appropriate signal as the input signal inputted to the output module P4 based on the coupling status of the common electrode. The compensation signal is generated by the feedback signal and the selectable input signal together in the output module P4, thereby capable of outputting an appropriate compensation signal when there is coupling effect on the common electrode and guaranteeing the display effect of the display device.

Embodiment 2

Figure 5:
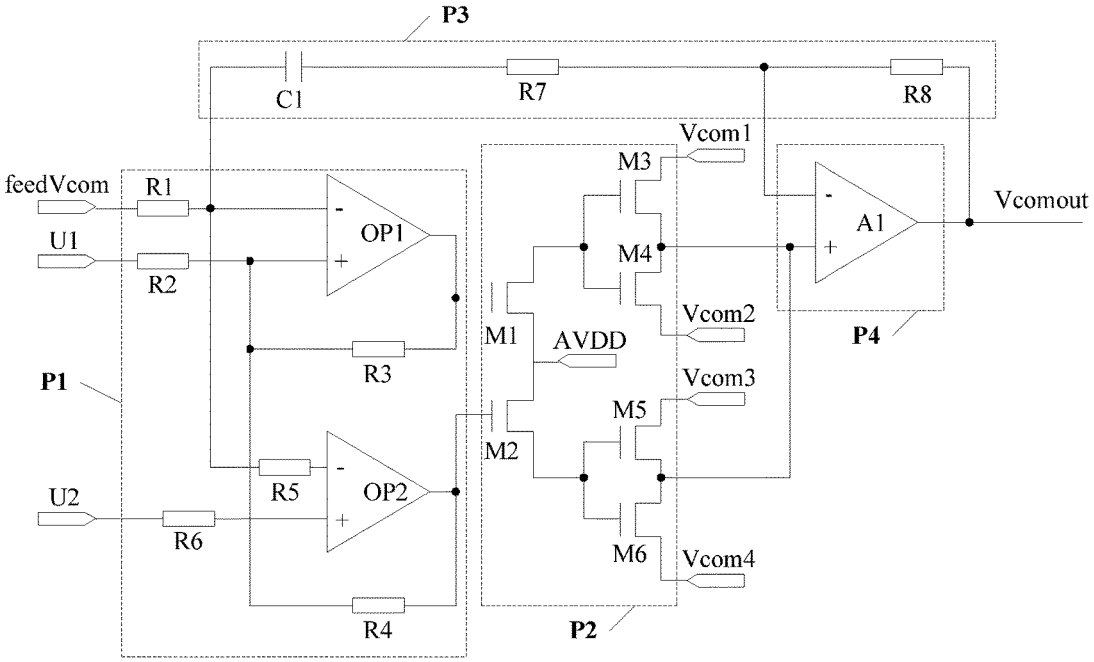
FIG. 5 schematically illustrates a compensation circuit for a common electrode voltage in accordance with another embodiment of the disclosure.

With reference to FIG. 5, a specific structure and connection relationship of the control module P1, the selection module P2, the transmission module P3 and the output module P4 of the compensation circuit for the common electrode voltage in the above embodiment of the disclosure will be described in the following.

As an example, the control module P1 comprises a first comparator OP1, a second comparator OP2, a first resistor R1, a second resistor R2, a third resistor R3, a fourth resistor R4, a fifth resistor R5 and a sixth resistor R6. An inverting input terminal "−" of the first comparator OP1 is connected to a first terminal of a first capacitor C1, a first terminal of the first resistor R1 and a first terminal of the fifth resistor R5 respectively; a non-inverting input terminal "+" of the first comparator OP1 is connected to a first terminal of the second resistor R2, a first terminal of the third resistor R3 and a first terminal of the fourth resistor R4 respectively; and an output terminal of the first comparator OP1 is connected to a second terminal of the third resistor R3 and a control terminal of a first switching element M1 respectively. An inverting input terminal "−" of the second comparator OP2 is connected to a second terminal of the fifth resistor R5; a non-inverting input terminal "+" of the second comparator OP2 is connected to a first terminal of the sixth resistor R6; and an output terminal of the second comparator OP2 is connected to a second terminal of the fourth resistor R4 and a control terminal of a second switching element M2 respectively. A second terminal of the first resistor R1 is connected to the feedback signal terminal feedVcom; a second terminal of the second resistor R2 is connected to the first reference voltage terminal U1; and a second terminal of the sixth resistor R6 is connected to the second reference voltage terminal U2. In some examples, the first reference voltage terminal U1 and the second reference voltage terminal U2 may both be grounded.

The selection module P2 comprises the first switching element M1, the second switching element M2, a third switching element M3, a fourth switching element 4, a fifth switching element M5 and a sixth switching element M6. A first terminal of the first switching element M1 is connected to a control terminal of the third switching element M3 and a control terminal of the fourth switching element M4; and a second terminal of the first switching element M1 is connected to the turn-on voltage terminal AVDD. A first terminal of the second switching element M2 is connected to the turn-on voltage terminal AVDD; and a second terminal of the second switching element M2 is connected to a control terminal of the fifth switching element M5 and a control terminal of the sixth switching element M6. A first terminal of the third switching element M3 is connected to the first common electrode voltage terminal Vcom1; and a second terminal of the third switching element M3 is connected to a non-inverting input terminal "+" of an amplifier A1 in the output module P4. A first terminal of the fourth switching element M4 is connected to the non-inverting input terminal "+" of the amplifier A1 in the output module P4; and a second terminal of the fourth switching element M4 is connected to the second common electrode voltage terminal Vcom2. A first terminal of the fifth switching element M5 is connected to the third common electrode voltage terminal Vcom3; and a second terminal of the fifth switching element M5 is connected to the non-inverting input terminal "+" of the amplifier A1 in the output module P4. A first terminal of the sixth switching element M6 is connected to the non-inverting input terminal "+" of the amplifier A1 in the output module P4; and a second terminal of the sixth switching element M6 is connected to the fourth common electrode voltage terminal Vcom4.

The transmission module P3 comprises the first capacitor C1, a seventh resistor R7 and an eighth resistor R8. A first terminal of the first capacitor C1 is connected to the first terminal of the first resistor R1 and the inverting input terminal "−" of the first comparator OP1 respectively; and a second terminal of the first capacitor C1 is connected to a first terminal of the seventh resistor R7. A second terminal of the seventh resistor R7 is connected to a first terminal of the eighth resistor R8 and the inverting input terminal "−" of the amplifier A1 of the output module P4 respectively.

The output module P4 comprises the amplifier A1; and a connection relationship of the inverting input terminal "−,"

the non-inverting input terminal "+" and the output terminal of the amplifier A1 may be referred to in the above description.

It is noted that the above switching elements may be transistors. If the switching elements are all transistors, then the control terminal is a gate electrode, and one of the first terminal and the second terminal is a source electrode while the other of the first terminal and the second terminal is a drain electrode. A polarity of the third switching element M3 is opposite to that of the fourth switching element M4, and a polarity of the fifth switching element M5 is opposite to that of the sixth switching element M6; that is, a polarity of a signal needed to turn on the third switching element M3 is opposite to a polarity of a signal needed to turn on the fourth switching element M4, and a polarity of a signal needed to turn on the fifth switching element M5 is opposite to a polarity of a signal needed to turn on the sixth switching element M6. The first comparator OP1 and the second comparator OP2 may be, for example, hysteresis comparators, thereby capable of increasing a response speed of the comparators and preventing self-oscillation of the compensation circuit for the common electrode voltage. The amplifier A1 may be for example a linear amplifier. Moreover, a voltage of the signal of the first common electrode voltage terminal Vcom1 is higher than a voltage of the signal of the third common electrode voltage terminal Vcom3, the voltage of the signal of the third common electrode voltage terminal Vcom3 is higher than a voltage of the signal of the second common electrode voltage terminal Vcom2, and the voltage of the signal of the second common electrode voltage terminal Vcom2 is higher than a voltage of the signal of the fourth common electrode voltage terminal Vcom4. The turn-on voltage terminal AVDD outputs a constant signal continuously, and the constant signal allows the third switching element M3 and the sixth switching element M6 to be turned on.

With reference to the structure of the compensation circuit for the common electrode voltage in Embodiment 2, a driving method for the compensation circuit for the common electrode voltage will be described in the following with reference to an example in which: the turn-on voltage terminal AVDD outputs a high level signal continuously; a control signal needed to turn on the first switching element M1, the second switching element M2, the fourth switching element M4 and the fifth switching element M5 is a low level signal; and a control signal needed to turn on the third switching element M3 and the sixth switching element M6 is a high level signal.

It is noted that, the signal of the first reference voltage terminal U1 is introduced into the non-inverting input terminal "+" of the first comparator OP1. Based on the voltage of the signal of the first reference voltage terminal U1, a resistance of the second resistor R2, a resistance of the third resistor R3 and an output ability of the first comparator OP1, it is capable of calculating and obtaining upper and lower thresholds of the first comparator OP1, where the upper threshold of the first comparator OP1 is higher than its lower threshold. It can be contemplated that, upper and lower thresholds of the second comparator OP2 can also be obtained through calculation, where the upper threshold of the second comparator OP2 is higher than its lower threshold. In the embodiment of the disclosure, the lower threshold of the first comparator OP1 is higher than the upper threshold of the second comparator OP2.

In a non-compensation stage, when there is no coupling effect on the common electrode, the voltage of the feedback signal of the feedback signal terminal feedVcom is lower than the lower threshold of the first comparator OP1 and higher than the upper threshold of the second comparator OP2. In this case, both of the first comparator OP1 and the second comparator OP2 output a high level signal, both of the first switching element M1 and the second switching element M2 are turned off, both of the third switching element M3 and the sixth switching element M6 are turned off, both of the fourth switching element M4 and the fifth switching element M5 are turned on, and the signal of the second common electrode voltage terminal Vcom2 and the signal of the third common electrode voltage terminal Vcom3 are transmitted to the non-inverting input terminal "+" of the amplifier A1. As the voltage of the signal of the third common electrode voltage terminal Vcom3 is higher than the voltage of the signal of the second common electrode voltage terminal Vcom2, the signal of the third common electrode voltage terminal Vcom3 is the input signal to the output module P4; and the amplifier A1 generates and outputs the compensation signal based on the input signal inputted to the non-inverting input terminal "+" and the feedback signal inputted to the inverting input terminal "−."

In a compensation stage, under the situation that there is coupling effect on the common electrode and the feedback signal of the feedback signal terminal feedVcom rises (i.e., upward coupling), when the voltage of the feedback voltage received by the inverting input terminal "−" of the first comparator OP1 is higher than the upper threshold of the first comparator OP1, the output status of the first comparator OP1 changes, and the output status of the second comparator OP2 remains unchanged; the output terminal of the first comparator OP1 outputs a low level signal, and the output terminal of the second comparator OP2 outputs a high level signal; the first switching element M1 is turned on, the second switching element M2 is turned off, both of the third switching element M3 and the fifth switching element M5 are turned on, and both of the fourth switching element M4 and the sixth switching element M6 are turned off, and thus, the signal of the first common electrode voltage terminal Vcom1 and the signal of the third common electrode voltage terminal Vcom3 are transmitted to the non-inverting input terminal "+" of the amplifier A1. As the voltage of the signal of the first common electrode voltage terminal Vcom1 is higher than that of the signal of the third common electrode voltage terminal Vcom3, the input signal to the amplifier A1 is the signal of the first common electrode voltage terminal Vcom1; and the amplifier A1 generates and outputs the compensation signal in time based on the feedback signal and the input signal.

Alternatively, in the compensation stage, under the situation that there is coupling effect on the common electrode and the feedback signal descends (i.e., downward coupling), when the voltage of the feedback voltage received by the inverting input terminal "−" of the second comparator OP2 is lower than the lower threshold of the second comparator OP2, the output status of the first comparator OP1 changes, and the output status of the second comparator OP2 changes; the output terminal of the first comparator OP1 outputs a high level signal, and the output terminal of the second comparator OP2 outputs a low level signal; the first switching element M1 is turned off, the second switching element M2 is turned on, both of the third switching element M3 and the fifth switching element M5 are turned off, both of the fourth switching element M4 and the sixth switching element M6 are turned on, and thus, the signal of the second common electrode voltage terminal Vcom2 and the signal of the fourth common electrode voltage terminal Vcom4 are transmitted to the non-inverting input terminal "+" of the amplifier A1. As the voltage of the signal of the second common electrode voltage terminal Vcom2 is higher than that of the signal of the fourth common electrode voltage terminal Vcom4, the input signal to the amplifier A1 is the signal of the second common electrode voltage terminal Vcom2; and the amplifier A1 generates and outputs the compensation signal in time based on the feedback signal and the input signal.

Embodiment 3

The embodiment of the disclosure provides a display device comprising the compensation circuit for the common electrode voltage in any of the above embodiments. The display device may be for example an e-paper, a mobile phone, a tablet computer, a television, a display, a laptop computer, a digital photo-frame, a navigator or any products or components with a display function. The compensation circuit for the common electrode voltage in the display device is the same as or similar to the compensation circuit for the common electrode voltage described above, and similar description is not repeated herein.

Embodiments of the disclosure are described using a progressive approach respectively, identical or similar parts in various embodiments can be referred to with reference to each other, and similar description is not repeated herein.

In the description of the disclosure, specific features, structures, materials and characteristics may be combined as needed in one or more embodiments.

In the present disclosure, terms such as "first", "second" and the like used in the present disclosure do not indicate any sequence, quantity or significance but only for distinguishing different constituent parts. Also, the terms such as "a," "an," or "the" etc., are not intended to limit the amount, but indicate the existence of at lease one. The terms "comprises," "comprising," "includes," "including," etc., are intended to specify that the elements or the objects stated before these terms encompass the elements or the objects and equivalents thereof listed after these terms, but do not preclude the other elements or objects.

The foregoing are merely specific embodiments of the disclosure, but not limitative to the protection scope of the disclosure. One skilled in the art could devise variations or replacements that within the scope and the spirit of the present disclosure, those variations or replacements shall belong to the protection scope of the disclosure. Thus, the protection scope of the disclosure shall be defined by the accompanying claims.

The present disclosure claims the benefits of Chinese patent application No. 201610080841.7, which was filed on Feb. 4, 2016 and is incorporated herein in its entirety by reference as part of this application.

What is claimed is:

1. A compensation circuit for a common electrode voltage, comprising a control circuit, a selection circuit, a transmission circuit and an output circuit; wherein:

the control circuit is connected to a feedback signal terminal, a first reference voltage terminal, a second reference voltage terminal, the selection circuit and the transmission circuit respectively, and is configured to:

generate a control signal based on a feedback signal from the feedback signal terminal, a signal from the first reference voltage terminal and a signal from the second reference voltage terminal; and transmit the control signal to the selection circuit;

the selection circuit is connected to a first common electrode voltage terminal, a second common electrode voltage terminal, a third common electrode voltage terminal, a fourth common electrode voltage terminal, a turn-on voltage terminal and the output circuit respectively, and is configured to:

select one of a signal from the first common electrode voltage terminal, a signal from the second common electrode voltage terminal, a signal from the third common electrode voltage terminal and a signal from the fourth common electrode voltage terminal as an input signal based on the control signal and a signal from the turn-on voltage terminal; and transmit the input signal to the output circuit;

the transmission circuit is connected to the output circuit and is configured to transmit the feedback signal received from the control circuit to the output circuit; and the output circuit is configured to generate a compensation signal based on the feedback signal and the input signal.

2. The compensation circuit for the common electrode voltage of claim 1, wherein the control circuit comprises a first comparator, a second comparator, a first resistor, a second resistor, a third resistor, a fourth resistor, a fifth resistor and a sixth resistor;

an inverting input terminal of the first comparator is connected to the transmission circuit, a first terminal of the first resistor and a first terminal of the fifth resistor respectively;

a non-inverting input terminal of the first comparator is connected to a first terminal of the second resistor, a first terminal of the third resistor and a first terminal of the fourth resistor respectively;

an output terminal of the first comparator is connected to a second terminal of the third resistor and the selection circuit respectively;

an inverting input terminal of the second comparator is connected to a second terminal of the fifth resistor; a non-inverting input terminal of the second comparator is connected to a first terminal of the sixth resistor;

an output terminal of the second comparator is connected to a second terminal of the fourth resistor and the selection circuit respectively;

a second terminal of the first resistor is connected to the feedback signal terminal;

a second terminal of the second resistor is connected to the first reference voltage terminal; and a second terminal of the sixth resistor is connected to the second reference voltage terminal.

3. The compensation circuit for the common electrode voltage of claim 2, wherein the selection circuit comprises a first switching element, a second switching element, a third switching element, a fourth switching element, a fifth switching element and a sixth switching element;

a polarity of the third switching element is opposite to that of the fourth switching element;

a polarity of the fifth switching element is opposite to that of the sixth switching element;

a control terminal of the first switching element is connected to the control circuit;

a first terminal of the first switching element is connected to a control terminal of the third switching element and a control terminal of the fourth switching element;

a second terminal of the first switching element is connected to the turn-on voltage terminal;

a control terminal of the second switching element is connected to the control circuit;

a first terminal of the second switching element is connected to the turn-on voltage terminal;

a second terminal of the second switching element is connected to a control terminal of the fifth switching element and a control terminal of the sixth switching element;

a first terminal of the third switching element is connected to the first common electrode voltage terminal;

a second terminal of the third switching element is connected to the output circuit;

a first terminal of the fourth switching element is connected to the output circuit;

a second terminal of the fourth switching element is connected to the second common electrode voltage terminal;

a first terminal of the fifth switching element is connected to the third common electrode voltage terminal;

a second terminal of the fifth switching element is connected to the output circuit;

a first terminal of the sixth switching element is connected to the output circuit; and a second terminal of the sixth switching element is connected to the fourth common electrode voltage terminal.

4. The compensation circuit for the common electrode voltage of claim 3, wherein the transmission circuit comprises a first capacitor, a seventh resistor and an eighth resistor;

a first terminal of the first capacitor is connected to the control circuit, and a second terminal of the first capacitor is connected to a first terminal of the seventh resistor;

a second terminal of the seventh resistor is connected to a first terminal of the eighth resistor and the output circuit respectively.

5. The compensation circuit for the common electrode voltage of claim 4, wherein the output circuit comprises an amplifier, an inverting input terminal of the amplifier is connected to the transmission circuit, a non-inverting input terminal of the amplifier is connected to the selection circuit, and an output terminal of the amplifier is connected to the transmission circuit.

6. The compensation circuit for the common electrode voltage of claim 5, wherein the output terminal of the first comparator and the second terminal of the third resistor are connected to the control terminal of the first switching element;

the inverting input terminal of the first comparator, the first terminal of the first resistor and the first terminal of the fifth resistor are connected to the first terminal of the first capacitor;

the output terminal of the second comparator and the second terminal of the fourth resistor are connected to the control terminal of the second switching element;

the second terminal of the third switching element, the first terminal of the fourth switching element;

the second terminal of the fifth switching element and the first terminal of the sixth switching element are connected to the non-inverting input terminal of the amplifier; and the inverting input terminal of the amplifier is connected to the second terminal of the seventh resistor and the first terminal of the eighth resistor respectively.

7. The compensation circuit for the common electrode voltage of claim 5, wherein the amplifier is a linear amplifier.

8. The compensation circuit for the common electrode voltage of claim 3, wherein a voltage of the signal of the first common electrode voltage terminal is higher than a voltage of the signal of the third common electrode voltage terminal, the voltage of the signal of the third common electrode voltage terminal is higher than a voltage of the signal of the second common electrode voltage terminal, and the voltage of the signal of the second common electrode voltage terminal is higher than a voltage of the signal of the fourth common electrode voltage terminal.

9. The compensation circuit for the common electrode voltage of claim 2, wherein both the first comparator and the second comparator are hysteresis comparators.

10. The compensation circuit for the common electrode voltage of claim 2, wherein a lower threshold of the first comparator is higher than an upper threshold of the second comparator.

11. The compensation circuit for the common electrode voltage of claim 1, wherein a voltage of the signal of the first common electrode voltage terminal is higher than a voltage of the signal of the third common electrode voltage terminal, the voltage of the signal of the third common electrode voltage terminal is higher than a voltage of the signal of the second common electrode voltage terminal, and the voltage of the signal of the second common electrode voltage terminal is higher than a voltage of the signal of the fourth common electrode voltage terminal.

12. A display device comprising the compensation circuit for the common electrode voltage of claim 1.

* * * * *